US005136334A

United States Patent [19]

Camis et al.

[11] Patent Number: 5,136,334

[45] Date of Patent: Aug. 4, 1992

[54] METHOD AND APPARATUS FOR PREPARING LIQUID TONE FOR DIRECT TRANSFER TO THE MEDIA DURING ELECTROPHOTOGRAPHIC PRINTING

[75] Inventors: Thomas Camis; James G. Bearss; James A. Hall, all of Boise, Id.

[73] Assignee: Hewlett-Packard Company, Palo Alto, Calif.

[21] Appl. No.: 701,926

[22] Filed: May 17, 1991

[51] Int. Cl.[5] ..... G03G 15/10

[52] U.S. Cl. ..... 355/256; 118/645; 118/659; 355/326

[58] Field of Search ..... 355/245, 256, 279, 326, 355/327, 328; 118/659, 660, 661, 644, 645

[56] References Cited

U.S. PATENT DOCUMENTS 3,851,964 12/1974 Smith et al. ..... 355/279 X 5,047,808 9/1991 Landa et al. ..... 355/279 X

*Primary Examiner*—A. T. Grimley

*Assistant Examiner*—J. E. Barlow, Jr.

[57] ABSTRACT

Liquid toner conditioning apparatus for use in an electrophotographic color printer and including a stabilizing roller positioned adjacent to the surface of a photoconductive drum and operative for transforming discrete color toner particles on the surface of the drum into a stabilized unitary polymeric film structure which may be directly transferred onto an adjacent print medium. Advantageously, the stabilizing roller will include an inner core member which may be heated as well as connected to a source of either AC bias or DC bias or both. This stabilizing and toner conditioning roller further includes a soft elastomeric roller cover positioned around the periphery of the inner core member and has a smooth outer surface which makes direct contact with the developed toner layers on the surface of the adjacent photoconductive drum.

5 Claims, 2 Drawing Sheets

METHOD AND APPARATUS FOR PREPARING LIQUID TONE FOR DIRECT TRANSFER TO THE MEDIA DURING ELECTROPHOTOGRAPHIC PRINTING

TECHNICAL FIELD

This invention relates generally to electrophotographic printing and more particularly to electrophotographic color printing using liquid toners for transferring developed color images directly from a photoconductor to an adjacent print medium.

RELATED APPLICATION

In U.S. patent application Ser. No. 07/662,068 of Thomas Camis entitled "Deformable Biased Transfer Roller For An Electrophotographic Printer" filed Feb. 27, 1991, and assigned to the present assignee, there are disclosed and claimed new and useful improvements in the art and technology of electrophotographic printing. These improvements are operative to enhance the print quality of images transferred from a photoconductive drum to an adjacent print media.

In U.S. patent application Ser. No. 07/704,572, filed May 17, 1991 and entitled "Electrostatically Assisted Transfer Roller and Method for Directly Transferring Liquid Toner to a Print Medium", and assigned to the present assignee, there are disclosed and claimed still further new and useful improvements in the field of electrophotographic color printing. This invention and claimed process uses transparent color liquid toners in a novel direct transfer technique for developing the composite color image on the surface of a photoconductive drum and then transferring the image directly to the print media. Both of these commonly assigned applications are incorporated herein by reference.

The present invention described herein represents still further new and useful improvements in the art and technology of electrophotographic color printing, and particularly in the field of electrophotographic color printing using transparent liquid color toners.

BACKGROUND ART

In the field of electrophotographic color printing, one conventional approach to developing a color image on an organic photoconductor and then transferring the developed color image to an adjacent print medium is to use a so-called intermediate transfer member (ITM) which is located between a surface of the organic photoconductive drum and the surface of the print medium. Using this approach, liquid toners of cyan, yellow, magenta, and black are first transferred electrostatically in series from a conventional source of liquid toners to the surface of the organic photoconductor and then developed thereon such as by writing the desired color image with a controlled laser beam or other suitable light source. Color liquid toners are generally well known in the art of electrophotographic printing and are described in some detail, for example, in U.S. Pat. Nos. 4,925,766 and 4,946,753 issued to Elmasry et al and entitled "Liquid Electrophotographic Toners", both incorporated herein by reference.

When each of the colors of cyan, yellow, magenta, and black are individually developed on the organic photoconductive drum, the intermediate transfer member is then brought into intimate contact with the surface of the drum and is rotated against the drum surface to thereby transfer the written color images from the surface of the photoconductive drum to the intermediate transfer member. One example of a printing process using an intermediate transfer member in the transfer of the image from the photoconductive drum to the print media disclosed in U.S. Pat. No. 4,286,039 issued to Landa et al and incorporated herein by reference.

The use of the above described intermediate transfer member has been required in the above conventional electrophotographic color printing apparatus because of the fact that intimate contact between the toner and the print surface receiving the toner was essential for high quality transfer of the image from the surface of the photoconductive drum. The requirement for the use of this intermediate transfer member not only added cost and complexity to the electrophotographic printing apparatus, but it also brought with it critical alignment, reliability, and associated maintenance problems. In addition, since the developed liquid toners formed on the surface of the photoconductive drum were in discrete particle form and not held together satisfactorily within a properly charged unitary cohesive structure, prior attempts to transfer the color toners directly from the photoconductive drum to the print medium failed to completely transfer all of the developed toners to the print medium, thereby resulting in an unacceptable print quality.

DISCLOSURE OF INVENTION

The general purpose and principal object of the present invention is to provide a new and improved electrophotographic color printing apparatus which is operative to transfer the developed color toners and color images directly from the surface of a photoconductive drum to an adjacent print medium without going through an intermediate transfer step such as that described above using an intermediate transfer member positioned between the drum and the print medium.

Another object of this invention is to provide a new and improved electrophotographic color printing apparatus of the type described which is operative to eliminate the cost and complexity brought about by the prior art requirement for using this intermediate transfer member.

Another object of this invention is to provide a new and improved electrophotographic color printing apparatus of the type described which allows one to reduce the amount of liquid carrier which is transferred onto the photoconductive drum during the color image development process.

A unique and novel feature of this invention is the provision of a new and improved electrophotographic color printing apparatus of the type described which operates to form a compressed cohesive polymeric thin film structure of the developed color image. This thin film structure can then be transferred directly to the print medium with a high degree of resulting print quality heretofore unavailable with known direct transfer electrophotographic color liquid toner printing techniques.

Another feature of this invention is the provision of a new and improved electrophotographic color printing apparatus of the type described which operates to utilize a combination of mechanical, electrical and thermal energy to help prepare the developed color images for direct transfer to an adjacent media. This is accomplished by the use of a compliant toner conditioning roller which is electrically biased and heated and includes a soft smooth elastomeric outer surface which operates in intimate contact with an adjacent photoconductor surface.

Another feature of this invention is a provision of a new and improved electrophotographic color printing apparatus of the type described which employs a novel electrical and thermal conditioning roller scheme useful to stabilize the color image on the surface of the photoconductive drum, thereby preserving its fidelity and preventing it from adhering to the roller while the amount of liquid fluid surrounding the image, such as an isopar hydrocarbon, is reduced. In addition, the use of low level heating applied to the conditioning roller serves to initiate the transformation from discrete toner particles into a polymeric film structure on the surface of the photoconductive drum. Furthermore, electrical and mechanical forces applied to this soft conditioning roller operate to preserve the fidelity of the toner-on-toner images developed on the adjacent photoconductive drum.

Another feature of this invention is the provision of a liquid toner conditioning apparatus of the type described wherein either AC bias or DC bias or both can be adjusted to charge the toner to the proper sign and optimum charge level before being applied to the print medium.

The above purpose, objects, novel features, and related advantages of this invention are accomplished by the development of an electrophotographic color printing apparatus which includes, in combination, a photoconductive drum adjacent to which is positioned a source of liquid toner and electrostatic toner transferring means associated with the source of liquid toner for transferring the liquid color toners to the surface of the photoconductive drum. Image writing means are also positioned adjacent to the surface of the photoconductive drum for developing the color toners, and liquid toner conditioning means are positioned in intimate contact with the surface of the photoconductive drum for preparing and conditioning the developed color liquid toner layers for direct transfer from the surface of the photoconductive drum to an adjacent print medium.

In a preferred embodiment of this invention, the liquid toner conditioning means includes means for compressing the toner image on the surface of the photoconductive drum using a combination of electrostatic and mechanical forces and thermal energy, thereby stabilizing the image on the surface of the drum and preserving its fidelity and preventing it from adhering to the toner conditioning apparatus.

Also in a preferred embodiment of the invention, the toner conditioning means used for treating the liquid toner includes a deformable stabilizing roller which is rotatably mounted adjacent to the surface of the photoconductive drum, and this roller has an inner core member and a soft and smooth outer core member. In this novel arrangement, the inner core member may advantageously be provided with a source of heat and is further connected to a source of either DC bias or AC bias or both. Thus, the stabilizing roller is operative to utilize a combination of mechanical, electrical and thermal energy to condition the developed color images for direct transfer from the photoconductive drum to the adjacent print media.

Also in a preferred embodiment of the invention, the developed color image which has been conditioned by the toner conditioning roller is transferred to the print media using a heated transfer roller which may, if desired, be also connected to a source of DC bias voltage to electrostatically assist in the direct transfer of the color image to the print media in accordance with the novel teachings in the above copending application Ser. No. 07/704,572 filed May 17, 1991.

The above brief summary of the invention, together with its attendant advantages and novel features, will become more readily apparent from the following description of the accompanying drawings.

DESCRIPTION OF THE PREFERRED EMBODIMENT

Figure 1:
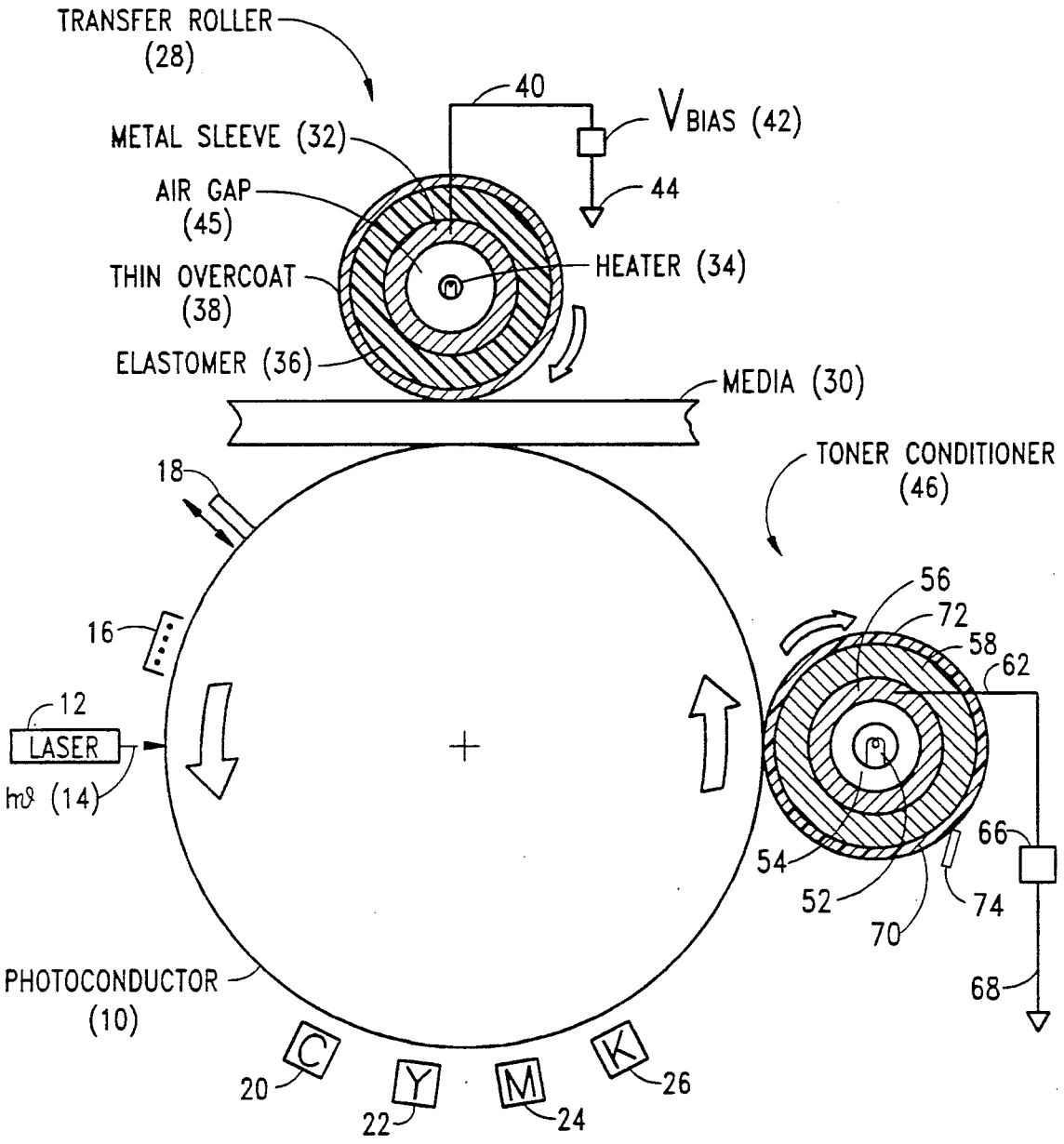
FIG. 1 is an abbreviated schematic cross sectional view of an electrophotographic color printer constructed in accordance with the present invention.

Referring now to FIG. 1, there is shown an organic photoconductive drum 10 which is positioned adjacent to a source 12 of monochromatic (e.g. laser) light 14 used for developing color images on the surface of the drum 10. The apparatus in FIG. 1 further includes a conventional corona charge mechanism 16 for the drum 10 and a conventional drum surface cleaning apparatus 18 mounted as shown adjacent to the surface of the photoconductive drum 10.

Cyan, yellow, magenta, and black color liquid toner sources 20, 22, 24, and 26 are located as shown adjacent to the lower surface of the photoconductive drum 10, and these color and black sources of transparent liquid toner are constructed and operated in a well known manner understood by those skilled in the electrophotographic color printing arts and are therefor not described in any significant detail herein. For a further discussion of the general construction and operation of these color and black sources 20, 22, 24, and 26 of liquid toner, reference may be made to the above identified Elmasry et al and Landa et al patents.

A heated and electrically biased transfer roller is designated generally as 28 and is rotatably mounted as shown above the upper surface of the photoconductive drum 10. The transfer roller 28 is operative to be driven against the upper surface of a print medium 30, such as paper, which passes between the outer surface of the transfer roller 28 and the outer surface of the organic photoconductive drum 10. Preferably, the transfer roller 28 is constructed and operated in accordance with the principles and teachings in the above identified copending application Ser. No. 07/704,572 filed May 17, 1991, and will include a conductive inner core member 32 within which a heater element 34 is located. The conductive inner core or metal sleeve member 32 is surrounded at its outer surface by a first cylindrically formed elastomer layer 36 which in turn is coated by a thin outer protective coating 38. The metal inner core member 32 is connected by way of a conductor 40 to a source 42 of electrical bias, the other side of which is grounded at node 44.

A cylindrical air gap 45 separates the centrally located heater element 34 from the inner metal sleeve 32, and the heater element which is positioned at the axis of rotation of the transfer roller 28 will preferably be an elongated quartz heater tube. This heater tube will typically be heated during an image transfer operation to a controlled elevated temperature on the order of 80°-90°

C. or greater to provide the thermal energy in combination with electrical and mechanical forces in the nip zone of the transfer roller 28 which makes direct contact with the media 30. Typically, the inner metal sleeve 32 will be DC biased to a voltage in excess of minus 900 volts DC, and a mechanical pressure will also be applied to the nip zone at a level on the order of five (5) psi or greater.

Figure 2:
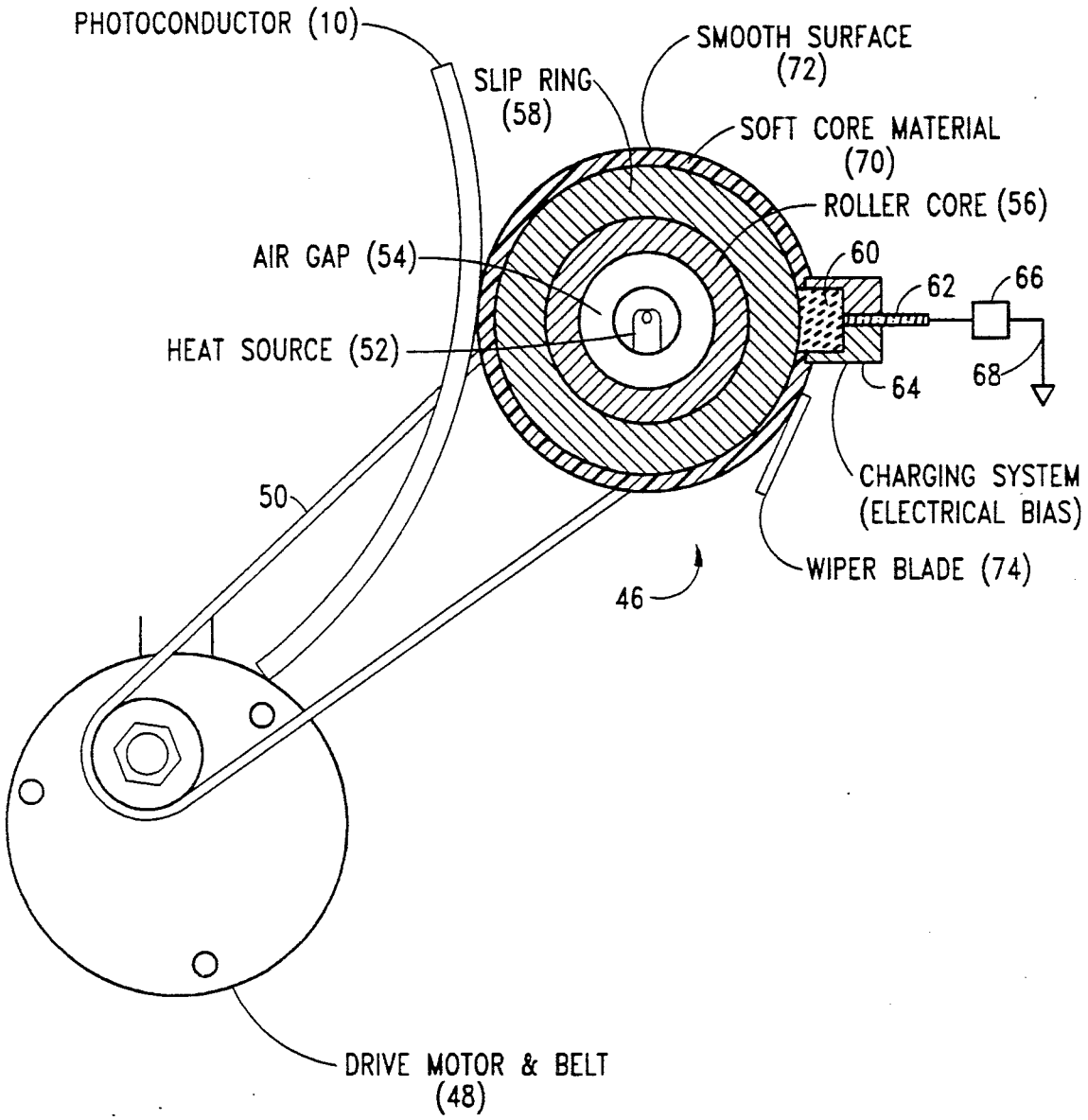
FIG. 2 is an enlarged view of the toner conditioning apparatus portion of the printer combination shown in FIG. 1.

Referring now to both FIGS. 1 and 2, a liquid toner conditioning and stabilizing apparatus is indicated generally as 46 and is located as shown on the right hand side of the photoconductive drum 10. This toner conditioning apparatus 46 is operatively driven by a drive motor 48 and drive belt 50 in intimate contact with the outer surface of the photoconductive drum 10. The toner conditioning and stabilizing apparatus 46 also includes a centrally disposed heating element 52 which is surrounded first by a cylindrical air gap 54 and then by an inner metal roller core 56 of a suitable metal such as aluminum. The heating element 52 may also be an elongated quartz tube positioned at the rotational axis of the conditioning roller 46. The roller core member 56 is surrounded by a metal slip ring 58 which is in turn connected through a bias electrode 60 and an interconnect pin 62 within the adjacent housing 64 to source 66 of DC bias, the other side of which is grounded at node 68. The outer surface of the metal slip ring 58 is surrounded by a soft core elastomer material 70 having a very smooth outer surface 72 which is required in the toner conditioning operation to be described below. The outer core member 70 may for example be a conductive silicone or a conductive polyurethane material. The reason that the soft core material 70 appears discontinuous in the figures is that the elements 60, 62, and 64 of the biasing arrangement for the slip ring 58 are located in front of the soft core roller 70.

In operation, the heated and biased transfer roller 28 and media 30 are initially moved away from the surface of the organic photoconductive drum 10 during the exposure and development process used for developing layers of cyan, yellow, magenta, and black transparent color toners, one on top of another, on the surface of the photoconductive drum 10. After each successive layer of cyan, yellow, magenta, and black color toner is initially applied to the surface of the photoconductive drum 10, it is then treated with the toner conditioning apparatus 46 on the right hand side of the drum 10 and then subsequently exposed by light 14 from the monochromatic light source 12 on the left hand side of the photoconductive drum 10.

Then, after the cyan, yellow, magenta, and black color toners have all been exposed and developed to a desired composite image one on top of another and conditioned and stabilized in series by the toner conditioning apparatus 46, the heated and biased transfer roller 28 and print medium 30 are then brought into intimate contact in the position shown in FIG. 1 with the surface of the photoconductive drum 10. Here the composite developed color image is transferred to the lower surface of the print medium 30 as a unitary and cohesive polymeric film which holds tightly together all of the developed color toners. As will be seen below, in the absence of using the toner conditioning and stabilizing apparatus 46 as shown in FIGS. 1 and 2, these color toners would be transferred in discrete particle form from the surface of the photoconductive drum 10 to the underside of the print medium 30. And, as previously indicated, prior art direct transfer electrophotographic color printers have been characterized by a somewhat inefficient and ineffective transfer of all of the developed color images and the discrete particle color toners onto a print medium. However, in accordance with the present invention, a high quality color image is now provided on the under surface of the print media 30.

Each of the sources of color liquid transparent toners 20, 22, 24, and 26 includes a combination of negatively charged toner particles which are immersed in a charged isopar toner carrier liquid. When the positively charged surface of the photoconductive drum 10 rotates past these liquid toner sources 20, 22, 24, and 26, the negatively charged toner particles are electrostatically pulled onto the surface of the photoconductive drum 10, while simultaneously the positively charged counter ions are stripped away from their negatively charged nuclei and onto an adjacent negatively charged substrate (not shown). However, some of the carrier liquid is pulled onto the surface of the photoconductive drum 10 along with the negatively charged toner particles which it surrounds and therefore needs to be conditioned and stabilized in order to develop the color-on-color layers of toner into a cohesive and unitary polymeric film. This is accomplished by operation of the toner conditioning and stabilizing apparatus 46 as shown on the right hand side of FIG. 1 and in the enlarged cross section view in FIG. 2.

From the above description of the toner conditioning apparatus 46, it is seen that this apparatus is operative to provide a combination of mechanical pressure, electrostatic forces, and a low level of thermal energy to the successive layers of liquid toner as they pass in succession counterclockwise against the smooth surface 72 of the outer conditioning soft core roller member 70. The outer roller member 70 is preferably a soft elastomeric material such as a polyurethane or conductive silicone material having a volume resistivity less than about $10^8$ ohm·centimeters and a Shore A Hardness less than 30. The soft elastomeric roller 70 outer cover layer must be designed to have a smooth surface finish which is useful to preserve the fidelity of images and must also be blade cleaned to remove excess carrier fluid therefrom.

The inner core 56 of the toner conditioning apparatus 46 is a cylindrical metal sleeve such as aluminum and biased to a maximum allowable DC potential of the same polarity as that of the liquid toner particles. This feature is useful in order to provide a recharging of any electrically discharged toner particles which will naturally take place during the operation of the above color toner development process. Both DC and AC bias may be used on conductor 62 to provide the proper sign and level of toner charge for the efficient transfer of the developed polymeric film on the outer surface of the -photoconductive drum 10 directly onto the undersurface of the print medium 30.

Thus, there has been described herein a novel electrophotographic color printing and toner conditioning apparatus 46 which is operative in an efficient manner to properly prepare developed transparent color liquid toners for direct transfer to a receiving sheet of paper. The electrically biased and heated conditioning roller 46 which is in intimate contact with the surface of the photoconductive drum 10 compresses the charged toner particles thereon which are received by the conditioning apparatus 46 in discrete particle form. This electrostatic and mechanical compression by the toner conditioning apparatus 46 of the multiple and serially deposited discrete particle films operates to preserve the fidelity of the images superimposed one upon another, and it also helps prevent degradation of these images. Such degradation may otherwise take the form of poor edge acuity around printed characters, streaks, and general toner scattering.

The electrostatic pressure, $P_e$, acting on the various toner layers can be shown from Maxwell's well known stress equation to be directly related to the net charge on the toner film times the average of the electrical field above and below the toner film. That is to say:

$$P_e=[(E_{AT}+E_{BT})/2]\cdot\sigma_{net} \qquad \text{Equation 1}$$

where $E_{AT}$ is the electrostatic field above the toner layer, $E_{BT}$ is the electrostatic field below the toner layer and $\sigma_{net}$ is equal to the net charge on the toner layer on the photoconductive drum 10. This relationship is applicable to the electrostatic pressure, $P_e$, at both the toner conditioning and stabilizing roller 46 and also to the electrostatically assisted transfer roller 28.

Thus, the biased and heated roller conditioning apparatus 46 will also serve to apply the proper toner charge level and polarity in the case where toners become charge deficient as indicated above. This toner conditioning apparatus 46 is also used to reduce and limit undesirable amounts of liquid carrier (e.g. isopar) that is normally carried out onto the print medium due to its presence on the photoconductor in both image and background regions. This isopar fluid is significantly removed by the conditioning apparatus 46 whose smooth outer surface 72 is continuously cleaned by the wiping action of the cleaning blade 74 as previously described to scrape away residual isopar from the surface 72 of the conditioning roller 46. Optimum cleaning is achieved by the use of a sharp cleaning blade 74 which brushes in intimate contact with the smooth surface 72 of the roller member 46 thereby enabling the isopar excess liquid to be collected in an adjacent container (not shown).

Various modifications may be made in and to the above described preferred embodiment without departing from the spirit and scope of this invention. For example, the present invention is not limited by the particular materials or geometric configuration of the conditioning roller described herein, and this toner stabilizing roller 46 may be used in combination with many different types of electrophotographic writing schemes, color toner transferring techniques for applying toner to the photoconductive drum and with various different additional schemes for aiding in the direct transfer of the developed color toners from the surface of the photoconductive drum to an adjacent print media. Also, it should be understood that the present invention is not limited to use with the particular transfer roller apparatus 28 described herein. Accordingly, these and other design modifications are clearly within the scope of the following appended claims.

We claim:

1. Electrophotographic color printing apparatus including, in combination:

a. a photoconductive drum, b. a source of liquid toner adjacent to said photoconductive drum, c. electrostatic bias means associated with said source of liquid toner for transferring liquid toner layers to the surface of said photoconductive drum, d. means adjacent to said photoconductive drum for developing images in said toner layers thereon, e. liquid toner conditioning means positioned in intimate contact with said photoconductive drum for preparing and conditioning developed color liquid toner layers on said drum for direct transfer from the surface of said drum to an adjacent print medium which passes in intimate contact with the surface of said photoconductive drum, f. said liquid toner conditioning means including means for stabilizing and compressing a toner image on the surface of said photoconductive drum using thermal, electrostatic and mechanical forces, g. said stabilizing means including a roller member rotatably mounted adjacent to said photoconductive drum and having an inner core member and an outer cover thereon operative to rotate in direct contact with the surface of said photoconductive drum, thereby stabilizing the image on the surface of said drum and preserving its fidelity and preventing it from adhering to said roller while the amount of fluid vehicle carrying said toners is reduced, h. means for affixing a source of heat adjacent to said inner core member of said stabilizing roller, and i. means connecting said inner core member of said stabilizing roller to a source of either AC bias or DC bias or both.

2. The apparatus defined in claim 1 wherein said outer cover of said stabilizing roller is a soft elastomeric material.

3. Conditioning and stabilizing apparatus for integrating and converting toners for discrete particle form into a cohesive and unitary polymeric film, including in combination:

a. photoconductive means having an outer surface thereof for receiving successive liquid color toner films, b. conditioning and stabilizing means positioned in intimate contact with said surface of said photoconductive member, and c. means within said conditioning and stabilizing means operative for applying a combination of mechanical pressure, electrostatic forces, and thermal energy to said surface of said photoconductive member, whereby said liquid color toners may be compressed into a unitary and cohesive polymeric film with the toner particles therein recharged for subsequent transfer to a selected print medium.

4. The apparatus defined in claim 3 which includes means for connecting said conditioning and stabilizing means to a source of either AC bias or DC bias or both for thereby providing said electrostatic forces to said liquid color toner films.

5. Conditioning and stabilizing apparatus for integrating and converting toners form discrete particle form into a cohesive and unitary polymeric film, including in combination:

a. photoconductive means having an outer surface thereof for receiving successive liquid color toner films thereon, b. conditioning and stabilizing means positioned in intimate contact with said surface of said photoconductive member and operative for applying a combination of mechanical pressure, electrostatic forces, and thermal energy to said surface of said photoconductive member, whereby said liquid color toners may be compressed into a unitary and cohesive polymeric film with the toner particles therein recharged for subsequent transfer to a selected print medium, c. said conditioning and stabilizing means comprising a roller apparatus having an inner core member containing a heating element and connected to a source of either AC bias or DC bias or both, and d. an outer roller member surrounding said inner ore member and operative to be driven against the surface of said photoconductive member.

* * * * *